United States Patent [19]

Koller et al.

[11] Patent Number: 4,569,130

[45] Date of Patent: Feb. 11, 1986

[54] SERVING UTENSIL WITH INTEGRAL SCRAPER

[76] Inventors: Philip A. Koller, 1250 Humboldt St., #1702, Denver, Colo. 80218; Roy Waldman, 1835 Morton Ave., #1102, Vancouver, BC, Canada, V6G 1V3

[21] Appl. No.: 619,295

[22] Filed: Jun. 11, 1984

[51] Int. Cl.[4] ..... A47J 43/28

[52] U.S. Cl. ..... 30/128; 30/136; 294/7

[58] Field of Search ..... 30/136, 128; 294/7, 294/50; 30/129

[56] References Cited

U.S. PATENT DOCUMENTS

| | | | |
|---|---|---|---|
| 461,623 | 10/1891 | Schoch | 294/7 |
| 1,083,296 | 1/1914 | Pontious | 30/129 |
| 1,678,368 | 7/1928 | Thomas | 30/129 |
| 2,538,154 | 1/1951 | Hannigan | 294/7 |
| 2,873,522 | 2/1959 | Homola | 30/129 |
| 3,233,325 | 2/1966 | Perry | 30/129 |

*Primary Examiner*—Jimmy C. Peters

*Attorney, Agent, or Firm*—James R. Young

[57] ABSTRACT

A serving utensil for cakes and pies has a broad, flat blade with a slanted, upwardly extending rear portion and a tang extending rearwardly therefrom. An extendable planar scraper element is positioned in front of the slanted rear portion of the blade with a stem extending rearwardly through an opening in the slanted portion of the blade under the tang with a spring connected to the stem and to the tang to bias the scraper rearwardly. The scraper is normally positioned above the surface of the blade, but is is moveable downard to the blade and forward by a user's thumb pressure. A removable handle is slideably mounted on the tang and encloses the scraper stem and spring under the tang.

7 Claims, 5 Drawing Figures

SERVING UTENSIL WITH INTEGRAL SCRAPER

BACKGROUND OF THE INVENTION

This invention relates to culinary untensils, and more particularly to a food serving utensil having a broad blade suitable for slicing and serving cakes, pies and similar culinary items and incorporating a thumb-operated scraper within the handle to assist in pushing items from the surface of the blade as they are served.

It is considered to be appropriate, even elegant, in our culture to slice or cut some kinds of delicate dessert foods, such as cakes and pies, and serve them in unitary pieces intact and not crumbled or broken. In order to do so, it is often necessary to use a serving utensil having a broad blade or surface, such as a spatula, under the piece of food to completely support the bottom of the piece while it is being transferred to a serving plate. Such foods also often tend to stick to the serving utensil, thus requiring some additional utensil or device to scrape or push the piece gently off the serving utensil. Traditionally, a knife, fork, or some other second utensil has been used for this purpose, which requires the use of both of a person's hands to transfer a piece of such food gently onto a serving plate while keeping it neat and intact.

There have been some advances in serving utensils that allow the use of only one hand for serving pieces of cakes, pies, and the like. One such device includes a scraper positioned at the rear of the broad blade with a stem extending rearwardly from the scraper into the handle where it can be pushed forward with the user's thumb. A spring in the handle pulls the scraper back to the rear of the blade after the piece of cake or pie is removed. This concept is workable, but several problems remain that limit its acceptance and usefulness. For example, the slide and spring assembly in the handle collects food bits and residue, which is very difficult, if not impossible, to clean. Also, this prior art device has insufficient scraper travel to push especially sticky foods off the blade, and the scraper does not always scrape the blade surface effectively.

SUMMARY OF THE INVENTION

Accordingly, it is an object of this invention to provide a novel and improved serving utensil to facilitate serving pieces of cakes, pies, and other sliced foods with one hand, thus eliminating the need to use a second free hand or utensil to pursh food from the surface of the blade.

A further object of this invention is to facilitate access to all of the mechanical parts of the utensil to allow thorough cleaning of these mechanical parts which tend to harbor food materials subject to bacterial contamination.

A still further object of the present invention is that it minimizes the tendancy of the scraper to draw residual food material back up the blade toward the handle where it would otherwise accumulate during use.

The present invention provides a sliding element or stem in the handle of the serving knife that can be operated by the user's thumb to extend a scraper piece along the length of the blade for pusing or scraping pieces of food gently from the blade's surface when serving. An elastic element or spring returns the scraper to the base of the blade when the sliding element is released. In the preferred embodiment, the scraper guide hole is so shaped and the elastic element so positioned in relation to the scraper that the scraper will be in contact with the blade's surface when pressure is exerted on the sliding element by the thumb to move or hold it away from the handle, but the scraper element will lift from the blade's surface after returning to the base of the blade to prevent accumulation of residual food material at the base of the blade. The handle exterior piece is removeable from the tang to expose and facilitate cleaning of the mechanical parts.

These and other objects of the present invention will become more readily appreciated and understood from a consideration of the following detailed description of the preferred embodiment when taken together with together with the accompanying drawings, in which:

DETAILED DESCRIPTION OF THE PREFERRED EMBODIMENT

Figure 1:
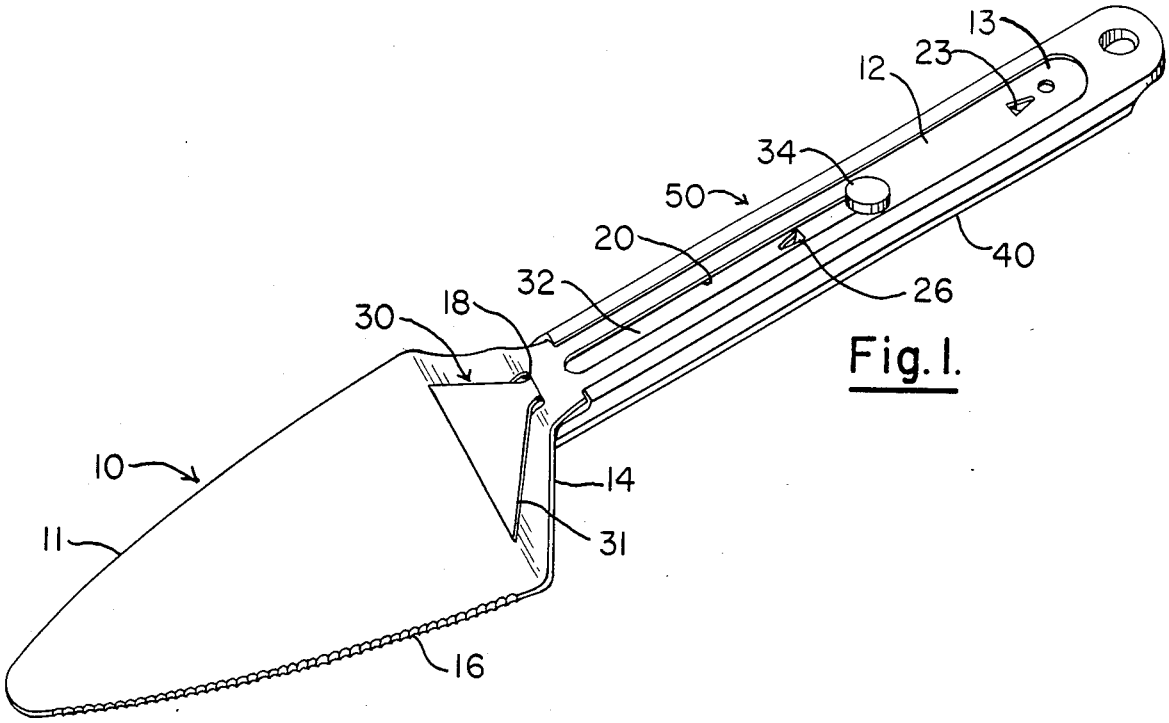
FIG. 1 is a perspective view of the serving knife showing the scraper at rest against the transition piece at the base of the blade.

In the drawings, a perspective view of the serving utensil 10 with an integral scraper assembly 30 is shown as FIG. 1. The serving utensil 10 is comprised essentially of a broad blade 11 connected to a handle assembly 50, with the scraper assembly 30 mounted in the handle assembly 50 in such a manner that the scraper element 31 is moveable forward to scrape or push food off the blade 11. The flat blade 11 has a slanted portion or transition piece 14 extending rearwardly and upwardly from the main plane of blade 11 which narrows and converges to a rearwardly extending handle mounting member or tang 12. The scraper assembly 30 has a broad, flat scraper member 31 positioned in front of the slanted portion 14 of blade 11. A traction and thrust member or stem 32 extends rearwardly from the top of scraper member 31 through an opening 18 in the slanted portion 14 and under tang 12. The blade 10 is shown in a nearly triangular shape, but any shape reasonably relating to the action of the scraper 30 along its thrust line might be used. The blade may have a serrated edge 16 along any portion or over the entirety of its perimeter.

Figure 3:
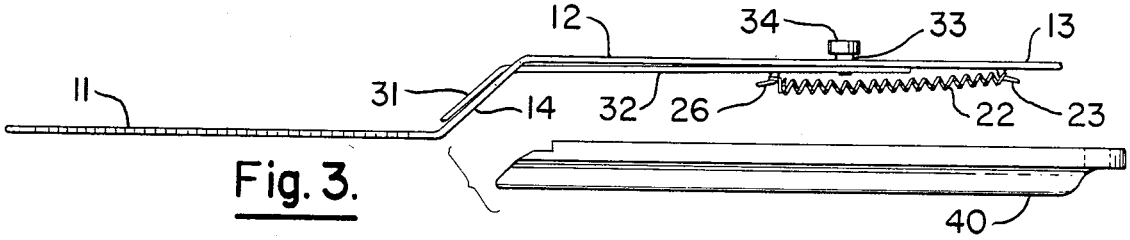
FIG. 3 is a side elevation of the serving knife with the handle piece removed from the handle mount or tang.
Figure 5:
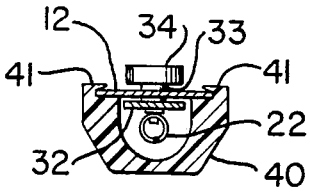
FIG. 5 is a sectional view of the assembled handle taken along the plate 5—5 in FIG. 3.

The handle assembly is comprised of the elongated planar handle mount or tang 12 and a removable handle piece 40. An elongated slot 20 in the tang 12 runs from a point near the slanted portion 14 of blade 11 along the center of the tang 12 toward its distal end 13. As shown in FIGS. 3 and 5, a short shank or slide member 33 mounted near the distal end 13 on stem 12 protrudes upwardly through the slot 20 and is retained therein by an enlarged knob 34. A spring 22 is attached to a hook 23 on the underside of the tang 12 at a point near its distal end 13 and to another hook 26 under stem 32 to bias the scraper 31 against the slanted portion 14 of blade 11.

Figure 4:
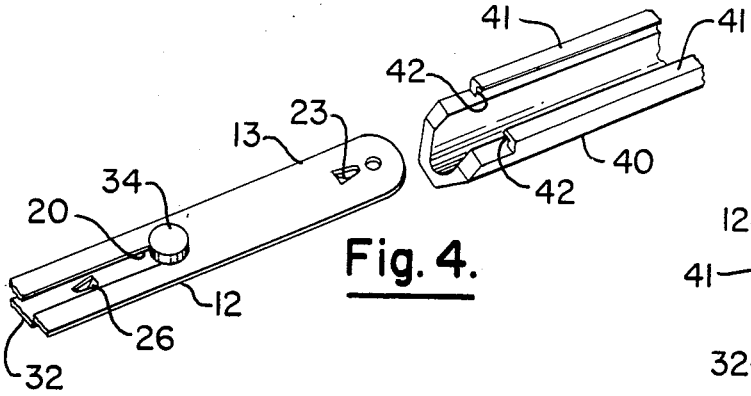
FIG. 4 is a perspective view of the handle mount or tang and handle piece showing their relation just prior to engagement or just after disengagement of the handle mount or tang with the handle piece groove.

The handle piece 40 has a U-shaped cross-section over most of its length, as shown in FIG. 5. A pair of tracks 41 with inwardly facing grooves 42 are positioned longitudinally along the upper edges of the handle piece 40 so that the handle piece 40 can be engaged with the tang 12. As shown in FIGS. 4 and 5, this assembly forms a handle with a hollow section to contain the stem 32 and a spring or other elastic element 22. The grooves 42 are of such proportion as to allow the handle 50 to slide off the tang 12, while providing sufficient friction to retain the tang 12 firmly in the handle piece 40 during use of the serving utensil 10. Retention can be improved by providing a slight increase in the width of the tang 12 near its junction with the slanted portion 14.

The scraper member 31 is made of such size and proportion that when it is retained against the slanted portion 14 by spring 22, it does not extend over the full depth of the slanted portion 14 to the upper surface of the blade 11. The shank 36 is of sufficient length to allow the stem 32 to be moved downwardly a sufficient distance from the tang 12 to lower the bottom edge of scraper 31 to the upper surface of blade 11. The hole 18 is deep enough to accommodate this downward movement of the stem 32 and scraper 31. The angle between the interior surface of the tang 12 and the slanted portion 14 of blade 11 is greater than 90 degrees, but the force of the spring 22 will cause the stem 32 to bear against the side of the guide hole 18 farthest from the blade 11. Under the influence of thumb pressure applied to the knob 34, the scraper member 31 will move to the surface of the blade 11 while it is being extended longitudinally outward from the hold 18. However, when thumb pressure is released and the scraper 31 retracts, it raises off the surface of the blade 11.

Figure 2:
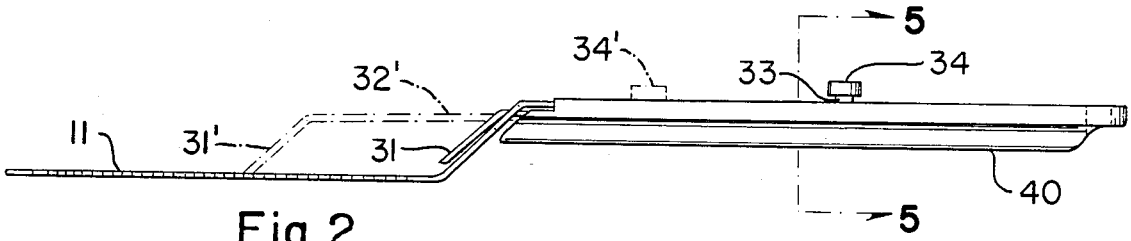
FIG. 2 is a side elevation of the serving knife showing the scraper piece at rest against the transition piece and with an extended position illustrated in broken lines.

In operation, the user grasps the handle 40 in his/her hand with the thumb of the same hand on the knob 34. When the knob 34 is depressed and pushed forward simultaneously, the scraper 31 moves downward to the surface of blade 11 and forward, as shown in FIG. 2, to push a piece of cake or piece (not shown) off the blade 11. In the forward position, the scraper 31', stem 32', and knob 34' are illustrated in broken lines. Then, after the cake or pie is removed from the blade 11, the knob 34 is released. This release allows the scraper 31 to rise upward above the blade 11, and the spring 22 pulls the scraper rearwardly to slanted portion 14. This rising motion of the scraper 31 minimizes the tendency of scraper 31 to drag food back into hole 18 during retraction, thus minimizing any likelihood of excess sticky foods jamming into the channel in handle 40. The slant of the scraper 31 in relation to the top surface of blade 11 also causes the scraper 31 to lift over food residue on the blade 11, rather than dragging it back, as the scraper 31 is retracted. Of course, when the serving is finished the handle 40 can be removed from the tang 12 for thorough cleaning.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A serving utensil comprising:

a handle;

a transition piece at one end of said handle forming an angle with the longitudinal axis of said handle;

a flat blade extending away from said handle held in set apart relation to said handle and parallel to the longitudinal axis of said handle by said transition piece;

a slide member slideably mounted on said handle;

a scraper piece of such shape and size as to allow it to lie upon the surface of said transition piece;

a traction and thrust member having a first end attached to said slide member and a second end attached to said scraper piece such that the scraper piece may be moved along the blade away from or toward the handle by movement of said slide member;

an elastic element having a first end attached to said handle and a second end attached to said traction and thrust member so as to urge said scraper piece against said transition piece;

an elongated planar handle mount extending from said transition piece; and an elongated handle piece of greater length than said handle mount having an open U-shaped cross-section extending from a first end along its length to a distance equal to the length of said handle mount, and a solid cross-section from that point to its other end, and having a groove just within the open section so as to allow said handle mount to engage said groove so as to form a handle having a void interior.

2. A serving utensil according to claim 1 wherein said handle mount has an elongated slot along a portion of its length and said thrust and traction member consists of an elongated element lying along the side of said handle mount facing said handle piece, and said slide member consists of a tab having a shank which passes through said slot, fastened at one end to said thrust and traction member and having at its other end an enlarged portion on the side of said handle mount opposite said thrust and traction member so as to confine said thrust and traction member in close relation to said handle mount, and said transition piece is formed with a guide hole through which said thrust and traction element passes.

3. A serving utensil according to claim 2 wherein said guide hole is elongated from a point near said handle mount toward said blade, the thrust and traction element extends along the handle mount to a point more distant from the transition piece than said tab, said tab has an elongated shank, said scraper piece is smaller than said transition piece along the dimension running from the handle mount to the blade, and the angle formed between the side of the handle mount facing the handle piece and the transition piece is between 90 and 180 degrees.

4. A serving utensil according to claim 3 wherein the elastic element is a spring.

5. A serving utensil according to claim 3 wherein the elastic element is a rubber band.

6. In serving utensil apparatus having a blade with a broad, flat planar surface and an upwardly slated rear portion and a tang with a slotted hole therein extending rearwardly from said upwardly slanted rear portion, said upwardly slanted rear portion having an opening therein above said flat planar surface and below said tang, a scraper element positioned over said planar surface and in front of said slanted rear portion with a stem extending rearwardly through said opening and under said tang, a shank extending upwardly from said stem and through said slotted hole with an enlarged knob thereon above said tang, a spring connected to said tang and to said stem for biasing said scraper element rearwardly, and a handle element mounted on said tang, the improvement comprising:

said scraper element being planar and extending downwardly from the top of said opening a distance less than the distance from the top of said opening to the top of said flat planar surface such that the bottom edge of said scraper element is a spaced distance above said planar surface when the top of said stem is in contact with the top of said opening, said opening extending downwardly a sufficient distance to accommodate sufficient downward movement of said stem to move the bottom edge of said scraper element into contact with the top of said flat planar surface, and said shank being of sufficient length between said stem and said knob to accommodate such downward movement of said scraper element into contact with said planar surface; and said handle element having a longitudinal channel therein with an open top, wherein said channel is large enough to have positioned and enclosed therein said stem and said springs, said handle element also being removeable from said tang to expose and provide access to said stem and said spring.

7. The improvement in serving utensil apparatus according to claim 6, further comprising a pair of parallel tracks positioned longitudinally on the upper edges of said handle element with each of said tracks having a longitudinal inwardly facing groove therein, and the lateral edges of said tang being sized and proportioned to slide snugly into said grooves for removeably mounting said handle element on said tang.

* * * * *